US008747570B2

(12) United States Patent
Hodge et al.

(10) Patent No.: US 8,747,570 B2
(45) **Date of Patent: *Jun. 10, 2014**

(54) BIO-BASED GLASS CLEANER

(71) Applicant: Ecolab USA Inc., St. Paul, MN (US)

(72) Inventors: Charles A. Hodge, Cottage Grove, MN (US); Amanda R. Blattner, Prior Lake, MN (US); Timothy J. Kohnke, Ogden, IA (US); Mark D. Levitt, West St. Paul, MN (US); Julie E. Marquardt, Savage, MN (US); Christopher M. McGuirk, Mensaha, WI (US); Carter M. Silvernail, Burnsville, MN (US); Dale Larson, Eagan, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/622,655

(22) Filed: Sep. 19, 2012

(65) Prior Publication Data

US 2013/0255719 A1 Oct. 3, 2013

Related U.S. Application Data

(60) Provisional application No. 61/537,388, filed on Sep. 21, 2011.

(51) Int. Cl.
*B08B 3/04* (2006.01)
*C11D 3/33* (2006.01)

(52) U.S. Cl.
USPC ..... 134/25.2; 134/25.3; 134/39; 134/42; 510/197; 510/199; 510/470; 510/474; 510/475; 510/477; 510/488; 510/499; 510/504; 510/525; 424/70.11; 424/70.13; 424/70.16; 424/70.28

(58) Field of Classification Search
USPC ..... 510/197, 199, 470, 474, 475, 477, 488, 510/499, 504, 525; 424/70.11, 70.13, 424/70.16, 70.28; 134/25.2, 25.3, 39, 42
See application file for complete search history.

(56) References Cited

U.S. PATENT DOCUMENTS

| | | | | |
|---|---|---|---|---|
| 5,030,374 | A | 7/1991 | Tranner | |
| 6,881,711 | B1 | 4/2005 | Gersiiun et al. | |
| 7,078,358 | B2 | 7/2006 | Roberts et al. | |
| 7,369,808 | B2 | 5/2008 | Wessner et al. | |
| 7,465,700 | B1 | 12/2008 | Ochomogo et al. | |
| 7,521,413 | B2 | 4/2009 | Ochomogo et al. | |
| 7,527,060 | B2 | 5/2009 | Hood et al. | |
| 7,592,301 | B2 | 9/2009 | Smith et al. | |
| 7,637,271 | B1 | 12/2009 | Cumberland et al. | |
| 7,696,145 | B2 | 4/2010 | Kaaret | |
| 7,939,486 | B2 | 5/2011 | Scheuing et al. | |
| 7,939,487 | B2 | 5/2011 | Scheuing et al. | |
| 7,964,544 | B2 | 6/2011 | Smith et al. | |
| 2004/0154640 | A1 | 8/2004 | Smith et al. | |
| 2005/0003990 | A1 | 1/2005 | Smith et al. | |
| 2005/0227898 | A1 | 10/2005 | Leskowicz et al. | |
| 2006/0094626 | A1 | 5/2006 | Horton, III | |
| 2006/0135394 | A1 | 6/2006 | Smith et al. | |
| 2007/0253926 | A1 | 11/2007 | Tadrowski et al. | |
| 2010/0160201 | A1 * | 6/2010 | Scheuing et al. | 510/180 |
| 2011/0098206 | A1 | 4/2011 | Lynch et al. | |

FOREIGN PATENT DOCUMENTS

| | | | |
|---|---|---|---|
| WO | WO 2011/055328 | 5/2011 | |
| WO | WO 2011/161605 | * 12/2011 | C11D 3/37 |

* cited by examiner

*Primary Examiner* — Brian P Mruk
(74) *Attorney, Agent, or Firm* — Amy J. Hoffman

(57) ABSTRACT

A concentrate cleaning composition includes water, glycerine, and at least one alkyl polyglycoside. The water may be present in an amount of greater than about 65% by weight. Glycerine may be present in an amount between about 0.05% and about 8% by weight of the cleaning composition. The at least one alkyl polyglycoside may be present in an amount of between about 1% and about 25% by weight of the cleaning composition.

26 Claims, No Drawings

BIO-BASED GLASS CLEANER

CROSS-REFERENCE TO RELATED APPLICATION

This application claims the benefit under 35 U.S.C §119 of U.S. Provisional Application No. 61/537,388, filed on Sep. 21, 2011, entitled "Bio-Based Glass Cleaner" which is herein incorporated by reference in its entirety.

TECHNICAL FIELD

The present invention is related to the field of cleaning compositions. In particular, the present invention is related to bio-based glass cleaning compositions having a low volatile organic compound concentration that may reduce streaking in the presence of water hardness.

BACKGROUND

Glass cleaners are often available in a form that is ready to use. A consumer will purchase a glass cleaner, such as, a window cleaner, and use the glass cleaner directly on a glass surface. Alternatively, the glass cleaner may be provided as a concentrate solution which is diluted with dilution water to form a use solution at the point of use or at an intermediate location. Diluting the concentrate at the point of use or at an intermediate location reduces the cost and the space required to transport and store the concentrate solution.

One reason that glass cleaners are provided in a form that is ready to use is to control the presence of "hardness" in the water used to prepare the ready to use glass cleaner, which has a tendency to cause precipitation of some components of the solution, such as anionic surfactants. Water hardness may also lead to aesthetically unpleasant streaking on glass surfaces.

Hardness is defined as the concentration of multivalent cations. Typically multivalent cations include $Ca^{2+}$ and $Mg^{2+}$ ions. Iron, aluminum and manganese can also contribute to hardness. One measurement of hardness defines hardness in terms of the calcium carbonate concentration where 1 grain is equivalent to 17.1 mg of calcium carbonate per liter.

Glass cleaners also typically include a volatile organic compound (VOC) such as but not limited to solvents such as ethanol and alkanol amines such as monoethanolamine. A compound is non-volatile if its vapor pressure is below 0.1 mm Hg at 20° C. VOCs have been the subject of regulation by different government entities, the most prominent regulations having been established by the California Air Resource Board in its General Consumer Products Regulation. Thus, it may be desirable to formulate glass cleaners containing low or no VOCs.

SUMMARY

The present invention includes a concentrate cleaning composition that includes water, glycerine, and at least one alkyl polyglycoside.

In one embodiment, the present invention is a method of using a cleaning solution which includes applying the cleaning composition to a hard surface and wiping the hard surface to remove the cleaning composition.

In another embodiment, the present invention is a method of forming a use solution which includes mixing dilution water with the concentrate cleaning composition to form a use solution.

In other embodiments, the concentrate cleaning composition may be substantially free of a solvent. Further, the concentrate cleaning composition may have a low concentration of volatile organic compounds or may be substantially free of volatile organic compounds.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

In one embodiment, the concentrate cleaning composition can include water, glycerine, at least one alkyl polyglycoside, and optionally at least one amino-carboxylate. The concentrate cleaning composition can be substantially free of organic solvents such that the concentrate cleaning composition has a low concentration of or is substantially free of volatile organic compounds. The concentrate cleaning composition can also have a high bio-based content. Bio-based content can be determined using ASTM Method D6866, entitled Standard Test Methods for Determining the Bio-based Content of Natural Range Materials Using Radiocarbon and Isotope Ratio Mass Spectometry Analysis. More specifically, ASTM Method D6866 uses radiocarbon dating to measure the amount of new carbon present in a product as a percentage of the total organic carbon by comparing the ratio of Carbon 12 to Carbon 14. The water content of a product is not included as part of bio-based content as it contains no carbon.

As discussed further below, the concentrate cleaning composition can be diluted with water, also known as dilution water, to provide a ready to use cleaning composition. The ready to use cleaning composition may result in low streaking and little to no build up when used to clean a substrate, such as a glass substrate, even when water hardness is present. The cleaning compositions can be applied in any environment where it is desirable to have low streaking and little to no buildup, particularly when water hardness is present. For example, the cleaning composition can be used in institutional applications and vehicle care applications. Such applications include but are not limited to: surface cleaning and destaining, and kitchen and bath cleaning and destaining. A particularly suitable application is cleaning glass surfaces. Methods of using the cleaning composition are also provided.

The concentrate cleaning composition includes a detersive amount of at least one alkyl polyglycoside. Suitable alkyl polyglycosides include but are not limited to alkyl polyglucosides and alkyl polypentosides. Alkyl polyglycosides are bio-based non-ionic surfactants which have wetting and detersive properties. Commercially available alkyl polyglycosides may contain a blend of carbon lengths. Suitable alkyl polyglycosides include alkyl polyglycosides containing short chain carbons, such as chain lengths of less than C12. In one example, suitable alkyl polyglycosides include C8-C10 alkyl polyglycosides and alkyl polyglycosides blends primarily containing C8-C10 alkyl polyglycosides. Suitable commercially available alkyl polyglucosides include AG 6202, AG 6206 and AG 6210 available from Akzo Nobel, Simusol SL 4, Simusol SL 8, Simusol SL 10, Simusol SL 11 W, Simusol SL 55, and Simusol SL 826 available from Seppic, and Glucopon 50 G, Glucopon 215 UP, Glucopon 225 DK, Glucopon 425 N, Glucopon 600 UP and Glucopon 625 UP available from BASF Corporation. Alkyl polypentosides are commercially available from Wheatoleo. Suitable commercially available polypentosides include Radia®Easysurf 6781, which contains chain lengths of about C8-C10 and is available from Wheatoleo. The cleaning composition, when provided as a concentrate, can include alkyl polyglycoside in an amount sufficient to provide a use solution having desired wetting and detersive properties after dilution with water. Suitable concentrations of alkyl polyglycosides include between about 0.05% and about 50% by weight of the concentrate cleaning composition. Further suitable concentrations of alkyl polyglycosides include between about 0.05% and about 25%, between about 1% and about 25%, and between about 1% and about 10% by weight of the concentrate cleaning composition.

The concentrate cleaning composition further includes glycerine, a non-volatile organic compound. Glycerine functions as a glide aid or lubricant. It has been discovered that glycerine helps a cloth "glide" across a glass surface during cleaning and particularly reduce streaking when water hardness is present. In comparison, when glycerine is not present in the current cleaning composition, a cloth will pull as it is wiped across the window and results in a greater amount of streaking.

Suitable concentrations of glycerine include between about 0.05% and about 30% by weight of the concentrate cleaning composition. Concentrations of glycerine between about 0.05% and about 8%, between about 0.1% and about 5%, and between about 0.05% and about 2% by weight of the concentrate cleaning composition may also be suitable. Further suitable concentrations of glycerine include between about 0.1% and about 2% by weight of the concentrate cleaning composition. When applied to a hard surface at room temperature, glycerine may reduce streaking caused by hard water.

The concentrate cleaning composition still further includes water. In one example, the majority of the concentrate cleaning composition can be water. In another example, the concentrate cleaning composition can include between about 20% and about 99.9%, between about 65% and about 99.9%, between about 65% and about 95%, or between about 85% and about 99.9% by weight water. In a further example, the concentrate cleaning composition includes at least about 90% water by weight of the concentrate cleaning composition. In a still further example, the concentrate cleaning composition can include at least about 91% or at least about 93% water by weight of the concentrate cleaning composition.

The water of the concentrate cleaning composition can be relatively free of hardness. In one example, the water of the concentrate cleaning composition is deionized water and is substantially free of dissolved solids. In other example, the water of the concentrate cleaning composition can be softened. Alternatively, the concentrate cleaning composition can be formed with water that has not been softened. That is, the concentrate can be formed with water that includes dissolved solids and that may be characterized as hard water.

A concentrate cleaning composition can consist essentially of at least one alkyl polyglycoside, glycerine and water. This concentrate cleaning composition can be essentially free of organic solvents, ammonia compounds, and alkanol amines. This concentrate cleaning composition can also have a low concentration of or is essentially free of volatile organic compounds. Further, this concentrate cleaning can have a relatively high bio-based content.

The concentrate cleaning composition optionally includes at least one amino-carboxylate such as but not limited to salts of ethylenediamine-tetraacetic acid (EDTA) and methyl glycine di-acetic acid (MGDA), and dicarboxymethyl glutamic acid tetrasodium salt (GLDA). The amino-carboxylate may also be in its acid form. Suitable commercially available MGDAs include but are not limited to Trilon® M available from BASF. Bio-based amino-carboxylates, such as GLDA, may also be used. Suitable bio-based amino-carboxylates may contain at least 40% bio-based content, at least 45% bio-based content, and more preferably, at least 50% bio-based content. For example, suitable commercially available GLDAs include but are not limited to Dissolvine® GL available from Akzo Nobel, which contains approximately 50% bio-based content.

The concentrate cleaning composition can contain a sufficient amount of the amino-carboxylate to assist with water hardness, such as hardness in the dilution water. For example, the amino-carboxylate may suspend or disperse water hardness, or total dissolved solids. Suitable concentrations of the amino-carboxylate and salts thereof in the concentrate cleaning solution include between about 0.05% and about 5% by weight of the concentrate cleaning solution. Particularly suitable concentrations of the amino-carboxylate and salts thereof in the concentrate cleaning solution include between about 0.1% and about 3% or between about 0.05% and about 2% by weight of the concentrate cleaning solution. The cleaning composition may contain a sufficient amount of amino-carboxylate to suspend or disperse water hardness up to about 5 grains, or approximately 85 mg/liter of calcium carbonate. High amino-carboxylate concentrations may contribute to solid build-up, which causes filming and streaking. The amino-carboxylate concentration of the concentrate cleaning composition may be designed so the use solution disperses or suspends water hardness while causing little to no solid build-up. Suitable MGDA to glycerin weight ratios include between about 10:1 and about 1:4. More suitable MGDA to glycerin weight ratios include between about 4:1 and about 1:2.

In some embodiments, polymers may also be added to the concentrate cleaning composition to assist with dispersing hardness and other non-hardness materials. Example non-hardness materials include total dissolved solids (TDS) such as sodium salts. Suitable polymers include sodium polycarboxylates, such as sodium polyacrylate, and acrylate/sulfonated co-polymers. In one example, the sodium polycarboxylate or acrylate/sulfonated co-polymer has a molecular weight less than about 100,000. In another example, the sodium polycarboxylate or acrylate/sulfonated co-polymer has a molecular weight less than about 50,000. In a further example, the sodium polycarboxylate or acrylate/sulfonated co-polymer has a molecular weight between about 5,000 and about 25,000. Suitable commercially available polymers include Acusol 460N available from Dow Chemical and Aquatreat AR-546 available from Akzo Nobel. Suitable concentrations of the polymer include between about 0.01% and about 5% by weight of the concentrate cleaning composition. Further suitable concentrations of the polymer include between about 0.05% and about 3% and between about 0.01% and about 5% by weight of the concentrate cleaning composition. The polymers can be used in combination with one another or alone.

The concentrate cleaning composition comprises an increased amount of bio-based components. Bio-based components are components that are composed, in whole or in significant part, of biological products. The amount of biological components or derivatives is referred to as bio-based content, which is the amount of bio-based carbon in the material or product expressed as a percent of weight (mass) of the total organic carbon in the material or product. Bio-based content can be determined using ASTM Method D6866, entitled Standard Test Methods for Determining the Bio-based Content of Natural Range Materials Using Radiocarbon and Isotope Ratio Mass Spectometry Analysis. More specifically, ASTM Method D6866 uses radiocarbon dating to measure the amount of new carbon present in a product as a percentage of the total organic carbon by comparing the ratio of Carbon 12 to Carbon 14. The water content of a product is not included as part of bio-based content as it contains no carbon. It is noted that bio-based content is distinct from product biodegradability. Product biodegradability measures the ability of microorganisms present in the disposal environment to completely consume the carbon components within a product within a reasonable amount of time and in a specified environment. In one example, the concentrate cleaning composition includes at least 49% bio-based content. More suitably, the concentrate composition includes at least 75%, at least 80%, at least 85%, at least 90%, or at least 95% bio-based content.

The pH of the concentrate cleaning composition may be between about 5 and about 12. More preferably, the pH of the concentrate cleaning composition may be below about 10. In one example, it may be preferable that the concentrate cleaning composition has a pH in a neutral range between about 6 and about 8. The pH of the concentrate cleaning composition may be adjusted as is known in the art. For example, 50% citric acid white may be used to lower the pH of the concentrate cleaning composition.

The concentrate cleaning composition may be substantially free of anionic surfactants such as sodium lauryl sulfate. It has been found that an anionic surfactant may have detrimental effects in the cleaning composition when water hardness is present. For example, an anionic surfactant may precipitate in the presence of water hardness. Additionally, an anionic surfactant may cause streaking in the presence of water hardness. The concentrate cleaning compositions of the present invention and the use solutions made there from provide sufficient detersivity and produces reduced streaking without the use of an anionic surfactant.

The concentrate cleaning composition may also be substantially free of polyoxypropylene-polyoxyethylene block co-polymers. It has been found that polyoxypropylene-polyoxyethylene block co-polymers may not reduce streaking and filming. In some compositions polyoxypropylene-polyoxyethylene block co-polymers may be removed from the composition without affecting the reduced streaking.

The concentrate cleaning composition may also be substantially free of organic solvents. Organic solvents such as ethanol, isopropyl alcohol, butyl glycol, typically contain volatile organic compounds and may have low bio-based content. The current concentrate cleaning composition is substantially free of organic solvents, leading to a low or zero volatile organic compound concentration and a higher bio-based content.

In contrast to many typical glass cleaners, the current cleaning composition does not require or include an organic cleaning solvent for soil removal. Although the current cleaning composition is solvent free, it does include glycerine as a glide aid. Glycerine is highly water soluble, making it a very poor solvent. Glycerine functions as a glide aid, helping a cloth slide across the surface being cleaned and resulting in smoothing streaking as the cloth is wiped across the surface.

Additionally, in contrast to many previous glass cleaners, the current concentrate cleaning composition may be substantially free of ammonia compounds and alkanol amines. Ammonia compounds are typically added to glass cleaners as an alkalinity source to help break up stains and because they evaporate relatively quickly. Example ammonia compounds include but are not limited to ammonium carbonate, ammonium bicarbonate, ammonium hydroxide, ammonium acetate, ammonium borate, ammonium phosphate, and ammonium. Alkanol amines, such as monoethanolamine, a derivative of ammonia, are also substantially not included in the current concentrate cleaning composition.

The concentrate cleaning composition also does not have a cloud point. Cloud point is the temperature at which a compound will precipitate out of solution. Some compounds decrease in solubility as the temperature of the solution increases. As the temperature approaches the cloud point, the surfactant molecules coagulate into clusters, called micelles. At the cloud point, the micelles reach a size so large that they interfere with the passage of light through the solution, which is observed as cloudiness in the solution. The cloud point may be determined by heating a solution until it becomes cloudy, and then allowing the solution to cool and measuring the temperature of the solution when it becomes clear. The compounds which cause the cloud point may also contribute to streaking, haziness and/or solids build-up on the substrate. The haziness and streaking may be particularly noticeable when the cleaning composition is applied to substrates which are exposed to elevated temperatures, such as windows in direct sunlight. It has been found that concentrate cleaning compositions that are substantially free of polyoxypropylene-polyoxyethylene block co-polymers do not have a cloud point. Thus, polyoxypropylene-polyoxyethylene block co-polymers may contribute to the cloud point.

Additional Functional Materials

The concentrate cleaning composition may contain other functional materials that provide desired properties and functionalities to the cleaning composition. For the purposes of this application, the term "functional materials" includes a material that when dispersed or dissolved in a use solution/concentrate solution, such as an aqueous solution, provides a beneficial property in a particular use. Examples of functional materials include but are not limited to: aqueous compatible solvents, sequestrants, surface chemistry modifiers, preservatives, defoaming agents, metal protectors, dyes/odorants, and microbiocides. In one embodiment, the cleaning composition consists essentially of water, glycerine, at least one alkyl polyglycoside, and optionally one member selected from the group consisting of: sodium polycarboxylates, acrylic/sulfonated co-polymers, anti-mist components, stability agents, amino carboxylates, dyes, fragrances, preservatives, and defoaming agents. It is noted that certain functional materials, such as dyes, fragrances, preservatives and defoaming agents may contain low concentrations of organic solvents, ammonia compounds, alkanol amines, and/or VOCs. These functional materials may be present at low concentrations (i.e., less than 1 wt. %) in concentrate cleaning compositions and use solutions that are essentially free of organic solvents, ammonia compounds, alkanol amines, and/or VOCs.

Aqueous Compatible Solvents

Although preferably the concentrate cleaning composition is free of organic solvents, it may optionally include a compatible solvent. Suitable solvents are soluble in the aqueous cleaning composition of the invention at use proportions. Preferred soluble solvents include lower alkanols, lower alkyl ethers, and lower alkyl glycol ethers. These materials are colorless liquids with mild pleasant odors, are excellent solvents and coupling agents and are typically miscible with aqueous cleaning compositions of the invention. Examples of such useful solvents include methanol, ethanol, propanol, isopropanol and butanol, isobutanol, ethylene glycol, diethylene glycol, triethylene glycol, propylene glycol, dipropylene glycol, mixed ethylene-propylene glycol ethers. The glycol ethers include lower alkyl (C1-8 alkyl) ethers including propylene glycol methyl ether, propylene glycol ethyl ether, propylene glycol propyl ether, dipropylene glycol methyl ether, dipropylene glycol ethyl ether, tripropylene glycol methyl ether, ethylene glycol methyl ether, ethylene glycol ethyl ether, ethylene glycol butyl ether, diethylene glycol methyl ether, diethylene glycol butyl ether, ethylene glycol dimethyl ether, ethylene glycol monobutyl ether, and others. The solvent capacity of the cleaners can be augmented by using monoalkanol amines.

Sequestrants

The concentrate cleaning composition can contain an organic or inorganic sequestrant or mixtures of sequestrants. Organic sequestrants such as citric acid, the alkali metal salts of nitrilotriacetic acid (NTA), EDTA, alkali metal gluconates, polyelectrolytes such as a polyacrylic acid, sodium gluconate, and the like can be used herein.

The concentrate cleaning composition can also comprise an effective amount of a water-soluble organic phosphonic acid which has sequestering properties. Preferred phosphonic acids include low molecular weight compounds containing at least two anion-forming groups, at least one of which is a phosphonic acid group. Such useful phosphonic acids include mono-, di-, tri- and tetra-phosphonic acids which can also contain groups capable of forming anions under alkaline conditions such as carboxy, hydroxy, thio and the like. Among these are phosphonic acids having the formulae: R1N[CH2PO3H2]2 or R2C(PO3H2)2OH, wherein R1 may be -[(lower)alkylene]N[CH2PO3H2]2 or a third —CH2PO3H2 moiety; and wherein R2 is selected from the group consisting of C1C6 alkyl.

The phosphonic acid may also comprise a low molecular weight phosphonopolycarboxylic acid such as one having about 2-4 carboxylic acid moieties and about 1-3 phosphonic acid groups. Such acids include 1-phosphono-1methylsuccinc acid, phosphonosuccinic acid and 2-phosphonobutane-1,2,4-tricarboxylic acid.

Other organic phosphonic acids include 1-hydroxyethylidene-1,1-diphosphonic acid (CH3C(PO3H2)2OH), available from ThermPhos as Dequest® 2010, a 58-62% aqueous solution; amino [tri(methylenephosphonic acid)] (N[CH2PO3H2]3), available from ThermPhos as Dequest® 2000, a 50% aqueous solution; ethylenediamine [tetra(methylene-phosphonic acid)] available from ThermPhos as Dequest® 2041, a 90% solid acid product; and 2-phosphonobutane-1,2,4-tricarboxylic acid available from Lanxess as Bayhibit AM, a 45-50% aqueous solution. It will be appreciated that, the above-mentioned phosphonic acids can also be used in the form of water-soluble acid salts, particularly the alkali metal salts, such as sodium or potassium; the ammonium salts or the alkylol amine salts where the alkylol has 2 to 3 carbon atoms, such as mono-, di-, or tri-ethanolamine salts. If desired, mixtures of the individual phosphonic acids or their acid salts can also be used. Further useful phosphonic acids are disclosed in U.S. Pat. No. 4,051,058, the disclosure of which is incorporated by reference herein.

The cleaning composition can also incorporate a water soluble acrylic polymer which can act to condition the use solutions under end-use conditions. Such polymers include polyacrylic acid, polymethacrylic acid, acrylic acid-methacrylic acid copolymers, hydrolyzed polyacrylamide, hydrolyzed polymethacrylamide, hydrolyzed acrylamidemethacrylamide copolymers, hydrolyzed polyacrylonitrile, hydrolyzed polymethacrylonitrile, hydrolyzed acrylonitrilemethacrylonitrile copolymers, or mixtures thereof. Water-soluble salts or partial salts of these polymers such as the respective alkali metal (e.g. sodium or potassium) or ammonium salts can also be used. The weight average molecular weight of the polymers is from about 500 to about 15,000 and is preferably within the range of from 750 to 10,000. Preferred polymers include polyacrylic acid, the partial sodium salt of polyacrylic acid or sodium polyacrylate having weight average molecular weights within the range of 1,000 to 6,000. These polymers are commercially available, and methods for their preparation are well-known in the art.

For example, commercially-available water-conditioning polyacrylate solutions useful in the present cleaning solutions include the sodium polyacrylate solution, Colloid® 207 (Colloids, Inc., Newark, N.J.); the polyacrylic acid solution, Aquatreat®AR-602-A (Alco Chemical Corp., Chattanooga, Tenn.); the polyacrylic acid solutions (50-65% solids) and the sodium polyacrylate powders (m.w. 2,100 and 6,000) and solutions (45% solids) available as the Goodrite®° K-700 series from B. F. Goodrich Co.; and the sodium- or partial sodium salts of polyacrylic acid solutions (m.w. 1000-4500) available as the Acrysol® series from Dow Chemical.

The present cleaning composition can also incorporate sequestrants to include materials such as, complex phosphate sequestrants, including sodium tripolyphosphate, sodium hexametaphosphate, and the like, as well as mixtures thereof. Phosphates, the sodium condensed phosphate hardness sequestering agent component functions as a water softener, a cleaner, and a detergent builder. Alkali metal (M) linear and cyclic condensed phosphates commonly have a M2O:P2O5 mole ratio of about 1:1 to 2:1 and greater. Typical polyphosphates of this kind are the preferred sodium tripolyphosphate, sodium hexametaphosphate, sodium metaphosphate as well as corresponding potassium salts of these phosphates and mixtures thereof. The particle size of the phosphate is not critical, and any finely divided or granular commercially available product can be employed.

Sodium tripolyphosphate is another inorganic hardness sequestering agent. Sodium tripolyphosphate acts to sequester calcium and/or magnesium cations, providing water softening properties. It contributes to the removal of soil from hard surfaces and keeps soil in suspension. It has little corrosive action on common surface materials and is low in cost compared to other water conditioners. Sodium tripolyphosphate has relatively low solubility in water (about 14 wt %) and its concentration must be increased using means other than solubility. Typical examples of such phosphates being alkaline condensed phosphates (i.e., polyphosphates) such as sodium or potassium pyrophosphate, sodium or potassium tripolyphosphate, sodium or potassium hexametaphosphate, etc.

Surface Chemistry Modifiers

Various surface chemistry modifiers can be incorporated into the cleaning composition. Examples of suitable commercially available surface chemistry modifiers include Laponite® silicates available from Southern Clay Products, Inc. The surface chemistry modifiers may have high surface free energy and high surface area which leads to interactions with many types of organic compounds. In one example, suitable surface chemistry modifiers have a surface free energy of about 200 mjoules/meter2 and a surface area of between about 750 and 800 m2/gram. A suitable concentration range for surface chemistry modifiers in the use solution is between about 10 ppm and about 100 ppm.

Preservatives

The cleaning composition can include effective amounts of preservatives. The preservatives may serve a preservative and stabilizing function. When the concentrate includes a preservative, the preservative can be provided in amount of between about 0.001 wt. % and about 1 wt. %.

Example preservatives include but are not limited to methylchloroisothiazolinone (CMIT), methylisothiazolinone (MIT), glutaraldehyde, 1,2-benzisothiazoline-3-one (BIT), polyhexamethylenebiguanide hydrochloride (PHMB), phenoxyethanol, methylparaben, propyl P-hydroxybenzoate (propyl paraben) and sodium benzoate NF dense. Another suitable preservative is Neolone™ M-10, a 9.5% active preservative available from Dow.

Defoaming Agent

The cleaning composition can include a defoaming agent to reduce the stability of foam and reduce foaming. When the concentrate includes a defoaming agent, the defoaming agent can be provided in an amount of between about 0.0001 wt. % and about 3 wt. %.

Examples of defoaming agents that can be used in the composition includes silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. Antifoam B, a 10% active water dilutable silicone emulsion available from Dow Corning, is another suitable defoaming agent. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein for all purposes.

Metal Protectors

The cleaning composition can contain a material that can protect metal from corrosion. Such metal protectors include for example sodium gluconate and sodium glucoheptonate.

Dyes/Odorants

Various dyes, odorants including perfumes, and other aesthetic enhancing agents may also be included in the detergent compositions. Examples of suitable commercially available dyes include, but are not limited to: Direct Blue 86, available from Mac Dye-Chem Industries, Ahmedabad, India; Fastusol Blue, available from BASF; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keystone Aniline and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Examples of suitable fragrances or perfumes include, but are not limited to: terpenoids such as citronellol, aldehydes such as amyl cinnamaldehyde, a jasmine such as C1S-jasmine or jasmal, and vanillin.

Anti-Mist Components and Stability Agents

The concentrate cleaning composition may optionally include an anti-mist component to reduce aerosol misting and increase droplet size when the cleaning composition is dispersed with a trigger sprayer. Among other benefits, reduced aerosol misting results in a greater amount of the use solution reaching the intended surface or substrate and a spray pattern with less aerosol at the edges.

Suitable anti-mist components include polyethylene oxide, polyacrylamide, and combinations thereof. PEO is a high molecular weight polymer. A suitable PEO can have a molecular weight between about 3,000,000 and about 7,000,000. One commercially available PEO is Polyox WSR 301, which has a molecular weight of about 4 million and is available from Dow. A suitable polyacrylamide can have a molecular weight between about 8 million and about 16 million, and more suitably between about 11 million and about 13 million. One commercially available polyacrylamide is SuperFloc® N-300 available from Kemira Water Solutions, Inc.

Suitable concentration ranges for polyethylene oxide, polyacrylamide and combinations thereof in the concentrate cleaning composition are between about 0.01% and about 3.0% by weight of the concentrate cleaning composition. Further suitable concentration ranges for polyethylene oxide, polyacrylamide and combinations thereof in the concentrate cleaning composition are between about 0.01% and 1.2% or between about 0.01% and 0.3% by weight of the concentrate cleaning composition.

The anti-mist component is chosen such that the resulting cleaning composition is a non-Newtonian fluid. Non-Newtonian fluids have a short relaxation time and have a direct correlation between shear and elongational viscosity (the elongational viscosity of the fluid equals three times the shear viscosity). Shear viscosity is a measure of a fluid's ability to resist the movement of layers relative to each other. Elongational viscosity, which is also known as extensional viscosity, is measure of a fluid's ability to stretch elastically under elongational stress. Non-Newtonian fluids do not have a direct correlation between shear and elongational viscosity and are able to store elastic energy when under strain, giving exponentially more elongational than shear viscosity and producing an effect of thickening under strain (i.e., shear thickening). The properties of a non-Newtonian fluid result in a cleaning composition use solution that has a low viscosity when not under shear but that thickens when under stress from the trigger sprayer. For example, the mean particle size of the dispensed cleaning composition can be about 11 microns or greater. A particularly suitable median particle size is about 50 microns or greater. A more particularly suitable median particle size is about 70 microns or greater, about 100 microns or greater, about 150 microns or greater, or about 200 microns or greater. Even at high anti-mist component concentration levels, such as those of the concentrate cleaning composition, the concentrate cleaning composition has a viscosity similar to that of water when not under strain.

The effectiveness of an anti-mist component to reduce misting and increase droplet size may degrade over time. A stability component may reduce degradation of the anti-mist component and improve the shelf-life of the concentrate cleaning composition. Suitable stability components may include antioxidants, chelants, propylene glycol and glycerine. Example antioxidants include, but are not limited to, Irganox® 5057, a liquid aromatic amine antioxidant, Irganox® 1135, a liquid hindered phenolic antioxidant, Tinogard® NOA, and Irgafos® 168, all available from BASF. Additional example antioxidants include vitamin E acetate. Example chelants include, but are not limited to, Dissolvine® GL-47-S, tetrasodium glutamate diacetate, and Dissolvine® GL-38, glutamic acid, N,N-diacetic acid, tetra sodium salt, both available from Akzo Nobel. A suitable concentration range of the stability components includes between approximately 100 parts per million (ppm) and approximately 50,000 ppm of the concentrate cleaning composition or between approximately 0.01% and 5% by weight. A further suitable concentration range of the stability components includes between approximately 100 ppm and approximately 200,000 ppm.

The concentrate cleaning compositions may include a combination of stability components, which may further improve the stability of the composition. For example, the concentrate cleaning compositions may include a combination of two or more stability components. In one example, the concentrate cleaning composition may include an antioxidant and a chelant. In a further example the concentrate cleaning composition may include Irganox® 1135 and Dissolvine® GL-47-S. Synergist effects have been observed when Irganox® 1135 and Dissolvine® GL-47-S are used in combination. For example, it has been found that when combined the total effect amount of Irganox® 1135 and Dissolvine® GL-47-S is half of that when each when used alone. Suitable anti-mist components, compositions containing anti-mist components and methods of use are also disclosed in the provisional application No. 61/537,390 entitled "Development of Extensional Viscosity for Reduced Atomization for Diluted Concentrate Sprayer Applications" which was filed on Sep. 11, 2011 and which is incorporated by reference herein, now U.S. patent application Ser. No. 13/622,649 filed Sep. 11, 2012.

As discussed further below, the concentrate cleaning solution may be diluted with water to form a use solution. The resulting use solution has a relatively low anti-mist component concentration. In one suitable use solution, the concentration of PEO is between about 0.002% and about 0.006% or between about 0.003% and 0.005% by weight of the use solution. In another suitable use solution, the polyacrylamide concentration is between about 0.002% and 0.01% by weight, and particularly between about 0.003% and about 0.007% by weight of the use solution. In a further suitable use solution, the concentration of PEO, PAA or a combination thereof is between about 0.002% and about 0.006% by weight, and particularly between about 0.003% and 0.005% by weight of the use solution.

The resulting use solution can also have a relative low stability component concentration. In one suitable use solution, the stability component concentration is between about 0.003% and about 7% by weight of the use solution.

The use solution can be dispensed with a standard transient trigger sprayer or a low velocity trigger sprayer, such as those available from Calmar. A typical transient trigger sprayer includes a discharge valve at the nozzle end of the discharge end of a discharge passage. A resilient member, such as a spring, keeps the discharge valve seated in a closed position. When the fluid pressure in the discharge valve is greater than the force of the resilient member, the discharge valve opens and disperses the fluid. A typical discharge valve on a stock trigger sprayer is a throttling valve which allows the user to control the actuation rate of the trigger sprayer. The actuation rate of the discharge valve determines the flow velocity, and a greater velocity results in smaller droplets. A low velocity trigger sprayer can contain a two-stage pressure build-up discharge valve assembly which regulates the operator's pumping stroke velocity and produces a well-defined particle size. In one example, the two-stage pressure build-up discharge valve can include a first valve having a high pressure threshold and a second valve having a lower pressure threshold so that the discharge valve snaps open and closed at the beginning and end of the pumping process. Example low-velocity trigger sprayers are commercially available from Calmar and are described in U.S. Pat. No. 5,522,547 to Dobbs and U.S. Pat. No. 7,775,405 to Sweeton which are incorporated herein in their entirety. The low velocity trigger sprayers may result in less drifting, misting and atomization of the use solution, and may reduce the amount of small droplets dispensed. The cleaning composition containing an antimist component may work in synergy with the low velocity trigger sprayer to produce a greater increase in droplet size than expect based on the components alone.

Use Solution

The concentrate cleaning composition can be diluted to provide a ready to use cleaning composition. In addition, the ready to use detergent composition can be further diluted to provide the use solution that is intended to be used to clean a surface. The ready to use composition can be referred to as the use solution when it is the solution that is intended to be used to provide cleaning of a surface. For example, in the case of a glass cleaner, the ready to use solution can be applied to the surface without further dilution and may be referred to as the use solution. Additionally, when cleaning hard surfaces, such as glass surfaces, it may be desirable to dilute the ready to use solution and clean the hard surface with the resulting use solution.

The cleaning composition can be provided as a concentrate for shipment to distributors or end users. The concentrate may then be diluted by the distributor or end user to provide a less concentrated cleaning composition and/or a ready to use cleaning composition.

Because the cleaning composition may be supplied as a concentrate, the cleaning composition may be diluted with the water available at the locale or site of dilution. It is recognized that the level of water hardness changes from one locale to another. Accordingly, the concentrate may be diluted with water having varying amounts of hardness depending on the locale or site of dilution. In general, water hardness refers to the presence of calcium, magnesium, iron, manganese, and other polyvalent metal cations that may be present in the water, and it is understood that the level of water hardness varies from municipality to municipality. Water hardness can be characterized by the unit "grain" where one grain water hardness is equivalent to 17.1 ppm hardness expressed as $CaCO_3$, and hard water is characterized as having at least 10 grains of hardness. For example, water is commonly available having at least 5 grains hardness, at least 10 grains hardness, and at least 20 grains hardness. The concentrate cleaning solution is formulated to handle differing water hardness levels found in varying locations without having to soften the water or remove the hardness from the water.

In one example, the concentrate cleaning solution is diluted with water to form a use solution containing between about 2% and about 8% by weight concentrate cleaning solution. One suitable use solution contains between about 200 ppm and about 600 ppm of at least on amino-carboxylate, between about 75 ppm and about 800 ppm glycerine, and between about 2,000 ppm and about 4,000 ppm of at least one alkyl polyglycoside. A more particularly suitable use solution contains between about 300 ppm and about 500 ppm of at least one amino-carboxylate, between about 100 ppm and about 700 ppm glycerine, and between about 2,500 ppm and about 3,500 ppm of at least one alkyl polyglycoside.

The use solution has a relatively low volatile organic compound (VOC) content, and preferably does not contain VOCs. VOCs have been the subject of regulation by different government entities, the most prominent regulations having been established by the California Air Resource Board in its General Consumer Products Regulation. A compound is non-volatile if its vapor pressure is below 0.1 mm Hg at 20° C.

Example compounds classified as a VOC include solvents such as but are not limited to acetone, ethanol, and propanol. Many cleaning compositions include organic solvents and/or VOCs to aid in water removal as a result of an azeotroping effect. The current use solution does not include an organic solvent or VOC content to assist in drying when the solution is applied to a hard surface. A suitable VOC content of the use solution includes less than about 3% VOCs by weight of the use solution, less than about 1% VOCs by weight of the use solution, or about 0% VOCs by weight of the use solution.

The use solution also has a relatively high bio-based content. As discussed above, water is excluded from the bio-based content calculation. Thus, the use solution has the same bio-based content as the concentrate cleaning composition. In one example, the use solution includes at least 49% bio-based content. More suitably, the use solution includes at least 75%, at least 80%, at least 85%, at least 90%, or at least 95% bio-based content.

Embodiments

The present invention relates to concentrate cleaning composition which can be diluted with dilution water to provide a use solution. Exemplary ranges for components of the concentrate cleaning compositions are shown in Table 1.

TABLE 1

| Concentrated Compositions | | | | |
|---|---|---|---|---|
| Component | First example range (wt %) | Second example range (wt %) | Third example range (wt %) | Fourth example range (wt %) |
| Water | 20-99.9 | 65-99.9 | 65-95 | 85-99.9 |
| Glycerine | 0.05-30 | 0.05-8 | 0.1-5 | 0.05-2 |
| Alkyl polyglycoside | 0.05-50 | 0.5-25 | 1-25 | 1-20 |
| Amino-carboxylate | 0-10 | 0.05-5 | 0.1-3 | 0.05-2 |
| sodium polycarboxylates or acrylic/sulfonated co-polymers | 0-5 | 0.01-5 | 0.05-3 | 0.01-5 |

EXAMPLES

The present invention is more particularly described in the following examples that are intended as illustrations only, since numerous modifications and variations within the scope of the present invention will be apparent to those of skill in the art. Unless otherwise noted, all parts, percentages, and ratios reported in the following examples are on a weight basis, and all reagents used in the examples were obtained or are available from the chemical suppliers described below or may be synthesized by conventional techniques.

Materials Used

Acusol™ 460N: a sodium polycarboxylate (25% active) available from Dow Chemical

Pluronic® N-3: a polyoxypropylene-polyoxyethylene block co-polymer (96.5% active) available from BASF Trilon® M: sodium methyl glycine di-acetate (40% active) available from BASF Glucopon® 215 UP: C8-C10 alkyl polyglycosides (63.5% active) available from BASF Aquatreat® AR-546: a low molecular weight acrylate/sulfonated co-polymer (37% active) available from Akzo Nobel Belclene® 810: a polymaleic homopolymer (50% active) available from BWA Water Additives Aquatreat® AR-801: a terpolymer of maleic/vinyl acetate/ethyl acrylate (40% active) available from Akzo Nobel Merquat® 281: a cationic acrylic polymer (41% active) available from Nelco Belclene® 200: a polymaleic homopolymer (50% active) available from BWA Water Additives Itaconix™ DSP2K: an itaconic acid polymer (85% active) available from Itaconix Oasis Pro™ 42: a glass cleaner containing an anionic surfactant and a polyoxypropylene-polyoxyethylene block copolymer and available from Ecolab, Inc.

Polyox™ WSR 301: a non-ionic polyethylene oxide having a molecular weight of 4,000,00 and available from Dow Chemical, Midland, Mich.

Glycerine: 96% active, available from VVF Illinois Services

Tartaric acid: available from American Tartaric Products Inc.

Liquitint® blue HP: a colorant available from Milliken Chemical

Example 1

Dispersion Test

The dispersion test is designed to measure the ability of a sample composition to disperse clay particulate. The ability of sample composition to disperse clay particulate gives an indication of the compositions ability to disperse hard water, total dissolved solids (TDS) and other particulates, such as soil, that may be present on hard surfaces, such as windows, glass surfaces and mirrors.

First, a 2% Kaolin clay mixture was created using water with a specified hardness. Next, the use solution sample composition was added to the Kaolin clay mixture according to the desired dosage, such as 30 ppm use solution or 30 ppm polymer actives, to create a Kaolin test mixture. The Kaolin test mixture was stirred for 10 minutes and then 50 mL of the Kaolin test mixture was poured into a 50 mL graduated cylinder. The Kaolin test mixture was allowed to stand at ambient temperature in the graduated cylinder. After 30 minutes, approximately 8 grams of the Kaolin test mixture was removed from the middle of the graduated cylinder and transferred into a pre-weighed container. The 8 gram sample was removed by gently inserting the pipette such that the tip of the pipette was at the 30 mL mark of the graduated cylinder. The 8 gram sample was placed in an oven and was dried in the pre-weighed container in an oven. The percent solids of the dried sample determined by dividing the weight of the dried sample by the original weight of the sample (8 grams) and multiplying by 100%.

Samples 1-2 and Comparative Samples A-B

For Samples 1-2 and Comparative Samples A-B, a concentrate cleaning composition was formed by mixing 0.05-2% Trilon® M, 0.05-2% glycerine, 1-20% Glucopon® 215UP, 0.1-1% fragrance, 0.01-1% dye and water to balance. Samples 1-2 also included 0.01-5% Acusol™ 460N (460N), 0.01-5% Pluronic® N-3 (N-3). The concentrate was diluted to form a use solution at 8 oz/gal using 5 grain dilution water. The use solution dosage into the Kaolin clay mixture is indicated in Table 2 along with the approximate bio-based content of each sample and the dispersion test results.

TABLE 2

| | Polymer(s) in glass cleaner use solution | Approx. bio-based content of use solution | Use solution dosage in Kaolin clay mixture | Water hardness mixed with Kaolin clay | % solids |
|---|---|---|---|---|---|
| Sample 1 | 460N & N-3 | 90% | 30 ppm of use solution | 10 grains | 0 |
| Sample 2 | 460N & N-3 | 90% | 30 ppm of polymer actives | 10 grains | 1.25 |
| Comp Sample A | None | 92% | 30 ppm of use solution | 10 grains | 0.125 |
| Comp Sample B | None | 92% | Same weight of use solution as Sample 2 | 10 grains | 0.25 |

A higher percent solids indicates greater dispersion of the clay. Sample 1 and Comparative Sample A had about equivalent performance. The higher percent solids of Sample 2 compared to Comparative Sample B indicates that 460N (a sodium polycarboxylate) and N-3 (a polyoxypropylene-polyoxyethylene block co-polymer) dispersed the Kaolin clay when dosed at 30 ppm of polymer actives.

Samples 3-10 and Comparative Samples C-E

Samples 3-10 investigated the following polymers: 460N in combination with N-3, 460N alone, Aquatreat® AR 546, Aquatreat® AR 810, Belclene® 200, Belclene® 801, Itaconix™ DSP2K and Merquat® 281. For Samples 3-10, a concentrate cleaning composition was formed by mixing 0.05-2% Trilon® M, 0.05-2% glycerine, 1-20% Glucopon® 215UP, 0.1-1% fragrance, and 0.01-1% dye with the polymer(s) indicated in Table 3 and water to balance. Comparative Samples C-E only included Trilon® M, glycerine, Glucopon® 215UP, fragrance, dye and water to balance.

TABLE 3

| | Polymer(s) | Wt % polymer in concentrate composition |
|---|---|---|
| Sample 3 | 460N & N-3 | 0.01-5% 460N; 0.01-5% N-3 |
| Sample 4 | 460N | 0.01-5% 460N |

TABLE 3-continued

| | Polymer(s) | Wt % polymer in concentrate composition |
|---|---|---|
| Sample 5 | Aquatreat AR 546 | 0.01-5% Aquatreat AR 546 |
| Sample 6 | Aquatreat AR 801 | 0.01-5% Aquatreat AR 801 |
| Sample 7 | Belclene 200 | 0.01-5% Belclene 200 |
| Sample 8 | Belclene 810 | 0.01-5% Belclene 810 |
| Sample 9 | Itaconix DSP2K | 0.01-5% Itaconix DSP2K |
| Sample 10 | Merquat 281 | 0.01-5% Merquat 281 |

The concentrate solutions were diluted to form use solutions at 8 oz/gal using 5 grain dilution water. Each use solution was added to a Kaolin clay mixture formed with 5 grain water. The use solution dosage in the Kaolin clay mixture was 30 ppm of polymer actives. Table 4 shows the approximate bio-based content of each use solution, the use solution dosage in the clay mixture and the results of the Kaolin clay dispersion test.

TABLE 4

| | Polymer(s) in glass cleaner use solution | Approx. bio-based content of use solution | Use solution dosage in Kaolin clay mixture | % solids |
|---|---|---|---|---|
| Sample 3 | 460N & N-3 | 90% | 30 ppm of polymer actives | 1.25 |
| Sample 4 | 460N | 91% | 30 ppm of polymer actives | 1.375 |
| Sample 5 | Aquatreat AR 546 | 87% | 30 ppm of polymer actives | 1.5 |
| Sample 6 | Aquatreat AR 801 | 87% | 30 ppm of polymer actives | 1.625 |
| Sample 7 | Belclene 200 | 87% | 30 ppm of polymer actives | 1.75 |
| Sample 8 | Belclene 810 | 87% | 30 ppm of polymer actives | 1.75 |
| Sample 9 | Itaconix DSP2K | 87% | 30 ppm of polymer actives | 1.625 |
| Sample 10 | Merquat 281 | 87% | 30 ppm of polymer actives | 0.125 |
| Comp Sample C | None | 92% | Same weight of use solution as Sample 3 | 1.375 |
| Comp Sample D | None | 92% | Same weight of use solution as Sample 4 | 1.375 |
| Comp Sample E | None | 92% | Same weight of use solution as Samples 5-10 | 1.625 |

When 5 grain water was used in the Kaolin clay mixture, MGDA (Trilon® M) was able to sufficiently disperse the Kaolin clay mixture as indicated by the comparable performances of Sample 3 compared to Comparative Sample C, Sample 4 compared to Comparative Sample D, and Samples 5-9 compared to Comparative Sample E. However, Sample 10, which contained Merquat 281, was not compatible with the testing conditions because of the polymer's cationic nature and the anionic nature of the clay particles.

Samples 11-18 and Comparative Examples F-H

Samples 11-18 were tested the same as Samples 3-10 and Comparative Examples F-H were the same as Comparative Examples C-E except the Kaolin clay mixture was prepared with 17 grain water hardness. Table 5 shows the approximate bio-based content of each use solution, the use solution dosage in the clay mixture and the results of the Kaolin clay dispersion test.

TABLE 5

| | Polymer(s) in glass cleaner use solution | Approx. bio-based content of use solution | Use solution dosage in Kaolin clay mixture | % solids |
|---|---|---|---|---|
| Sample 11 | 460N & N-3 | 90% | 30 ppm of polymer actives | 1 |
| Sample 12 | 460N | 91% | 30 ppm of polymer actives | 1 |
| Sample 13 | Aquatreat AR 546 | 87% | 30 ppm of polymer actives | 0.875 |
| Sample 14 | Aquatreat AR 801 | 87% | 30 ppm of polymer actives | 0.25 |
| Sample 15 | Belclene 200 | 87% | 30 ppm of polymer actives | 0.25 |
| Sample 16 | Belclene 810 | 87% | 30 ppm of polymer actives | 0.125 |
| Sample 17 | Itaconix DSP2K | 87% | 30 ppm of polymer actives | 0 |
| Sample 18 | Merquat 281 | 87% | 30 ppm of polymer actives | 0.125 |
| Comp Sample F | None | 92% | Same weight of use solution as Sample 11 | 0.125 |
| Comp Sample G | None | 92% | Same weight of use solution as Sample 12 | 0.25 |
| Comp Sample H | None | 92% | Same weight of use solution as Samples 13-18 | 0.125 |

Sample 11 is compared to Comparative Sample F, Sample 12 is compared to Comparative Sample G, and Samples 13-18 are compared to Comparative Sample H. When 17 grain water was used in the Kaolin clay mixture, 460N alone, 460N in combination with N-3, and Aquatreat® AR 546 improved dispersion of Kaolin clay. No improvement was seen for Samples 14-18 compared to Comparative Sample H.

Samples 19-34 and Comparative Samples I and J

For Samples 19-34, the use solutions of Samples 3-18 were added to Kaolin clay mixtures formed with 5 grain and 17 grain water at a dosage of 30 ppm of use solution. Comparative Samples I and J only included Trilon® M, glycerine, Glucopon® 215UP, fragrance, dye and water to balance. Table 6 shows the approximate bio-based content of each use solution, the water hardness used in the Kaolin clay mixture and the clay dispersion test results.

TABLE 6

| | Polymer(s) in glass cleaner use solution | Approx. bio-based content of use solution | Water hardness mixed with Kaolin clay | % solids |
|---|---|---|---|---|
| Sample 19 | 460N & N-3 | 90% | 5 grain | 2 |
| Sample 20 | 460N | 91% | 5 grain | 1.875 |

TABLE 6-continued

| | Polymer(s) in glass cleaner use solution | Approx. bio-based content of use solution | Water hardness mixed with Kaolin clay | % solids |
|---|---|---|---|---|
| Sample 21 | Aquatreat AR 546 | 87% | 5 grain | 1.875 |
| Sample 22 | Aquatreat AR 801 | 87% | 5 grain | 2 |
| Sample 23 | Belclene 200 | 87% | 5 grain | 2 |
| Sample 24 | Belclene 810 | 87% | 5 grain | 1.75 |
| Sample 25 | Itaconix DSP2K | 87% | 5 grain | 2 |
| Sample 26 | Merquat 281 | 87% | 5 grain | 1.875 |
| Sample 27 | 460N & N-3 | 90% | 17 grain | 0 |
| Sample 28 | 460N | 91% | 17 grain | 0 |

TABLE 6-continued

| | Polymer(s) in glass cleaner use solution | Approx. bio-based content of use solution | Water hardness mixed with Kaolin clay | % solids |
|---|---|---|---|---|
| Sample 29 | Aquatreat AR 546 | 87% | 17 grain | 0 |
| Sample 30 | Aquatreat AR 801 | 87% | 17 grain | 0.125 |
| Sample 31 | Belclene 200 | 87% | 17 grain | 0.125 |
| Sample 32 | Belclene 810 | 87% | 17 grain | 0.125 |
| Sample 33 | Itaconix DSP2K | 87% | 17 grain | 0 |
| Sample 34 | Merquat 281 | 87% | 17 grain | 0.125 |
| Comp Sample I | None | 92% | 5 grain | 1.875 |
| Comp Sample J | None | 92% | 17 grain | 0.125 |

Samples 19-26 performed about the same as Comparative Sample I, and Samples 27-34 preformed about the same as Comparative Sample J when dosed at 30 ppm use solution for Kaolin clay mixtures formed with 5 grain and 17 grain water, respectively.

Samples 35-50 and Comparative Samples K-Q

Samples 35-50 were prepared in the same manner as Samples 3-18 except the pH of the use solution was adjusted to 10 before the use solution was added to the Kaolin clay mixture. Comparative Samples K-Q did not include a polymer. The pH of use solutions were adjusted with 50% sodium hydroxide. The approximate bio-based content for each use solution and the clay dispersion test results are presented in Table 7.

TABLE 7

| | Polymer(s) in glass cleaner use solution | Approx. bio-based content of use solution | Use solution dosage in Kaolin clay mixture | Water hardness mixed with Kaolin | % solids |
|---|---|---|---|---|---|
| Sample 35 | 460N & N-3 | 90% | 30 ppm of polymer actives | 5 grain | 1.25 |
| Sample 36 | 460N | 91% | 30 ppm of polymer actives | 5 grain | 1.25 |
| Sample 37 | Aquatreat AR 546 | 87% | 30 ppm of polymer actives | 5 grain | 1.5 |
| Sample 38 | Aquatreat AR 801 | 87% | 30 ppm of polymer actives | 5 grain | 1.625 |
| Sample 39 | Belclene 200 | 87% | 30 ppm of polymer actives | 5 grain | 1.625 |
| Sample 40 | Belclene 810 | 87% | 30 ppm of polymer actives | 5 grain | 1.5 |
| Sample 41 | Itaconix DSP2K | 87% | 30 ppm of polymer actives | 5 grain | 0.75 |
| Sample 42 | Merquat 281 | 87% | 30 ppm of polymer actives | 5 grain | 0.125 |
| Sample 43 | 460N & N-3 | 90% | 30 ppm of polymer actives | 17 grain | 1.125 |
| Sample 44 | 460N | 91% | 30 ppm of polymer actives | 17 grain | 1 |
| Sample 45 | Aquatreat AR 546 | 87% | 30 ppm of polymer actives | 17 grain | 1 |
| Sample 46 | Aquatreat AR 801 | 87% | 30 ppm of polymer actives | 17 grain | 0 |
| Sample 47 | Belclene 200 | 87% | 30 ppm of polymer actives | 17 grain | 0.125 |
| Sample 48 | Belclene 810 | 87% | 30 ppm of polymer actives | 17 grain | 0.125 |
| Sample 49 | Itaconix DSP2K | 87% | 30 ppm of polymer actives | 17 grain | 0.125 |
| Sample 50 | Merquat 281 | 87% | 30 ppm of polymer actives | 17 grain | 0 |
| Comp Sample K | None | 92% | Same weight of use solution as Sample 35 | 5 grain | 1.25 |
| Comp Sample L | None | 92% | Same weight of use solution as Sample 36 | 5 grain | 1.25 |
| Comp Sample M | None | 92% | Same weight of use solution as Samples 37-42 | 5 grain | 1.625 |
| Comp Sample N | None | 92% | Same weight of use solution as Sample 43 | 17 grain | 0.25 |
| Comp Sample P | None | 92% | Same weight of use solution as Sample 44 | 17 grain | 0.25 |
| Comp Sample Q | None | 92% | Same weight of use solution as Samples 45-50 | 17 grain | 0.125 |

When 5 grain water was used in the Kaolin clay mixture, MGDA (Trilon® M) was able to disperse the hardness as seen by comparing Sample 35 to Comparative Sample K, Sample 36 to Comparative Sample L, and Samples 37-42 to Comparative Sample M.

When 17 grain water was used in the Kaolin clay mixture, 460N alone, 460N in combination with N-3, and Aquatreat® AR 546 improved dispersion of Kaolin clay as seen by comparing Sample 43 to Comparative Sample N, Sample 44 to Comparative Sample P and Sample 45 to Comparative Sample Q. No improvement was observed for Samples 46-50 compared to Comparative Sample Q.

Experiment 2

Streak Test

The streak test was designed to compare streaking among various samples. First, a use solution of each sample was created and 0.20 grams of the use solution was applied to a 2 inch by 2 inch double folded lint free test cloth. Then, the test cloth with use solution was wiped onto a 12 inch by 3 inch test area of a 12 inch tall by 12 inch wide by 3 mm thick glass mirror with plain edges by Stanley Basic Mirror Tiles. The test cloth was wiped three times 12 inches vertically and then wiped starting at the top of the mirror 3 inches horizontally until reaching the halfway point of the mirror surface. The use solution was allowed to air dry at ambient and then the streaking was visually observed. The amount of streaking was designated as follows: no streaks, very slight streaks, slight streaks, moderate streaks or severe streaks.

Samples 51-52 and Comparative Sample R

Samples 51 and 52 were prepared according to Table 8. Samples 51 included MGDA (Trilon® M) while Sample 52 included tartaric acid. Samples 51 and 52 also included 0.05-2% glycerine, 1-20% Glucopon® 215 UP, 0.1-1% glass cleaner fragrance, and 0.01-1% Liquitint® blue HP. Comparative Sample R was Oasis™ Pro 42, which includes sodium lauryl sulfate, an anionic surfactant.

TABLE 8

| | Water, deionized | Polymer | Trilon M | Tartaric acid | Approximate bio-based content of use solution |
|---|---|---|---|---|---|
| Sample 51 | 85-99.9% | 0% | 0.05-2% | 0% | 92% |
| Sample 52 | 85-99.9% | 0% | 0% | 0.05-2% | 96% |

The pH of concentrate Samples 51 and 52 were adjusted to 9.5. Sample 51 was adjusted with 50% citric acid white and Sample 52 was adjusted with 50% sodium hydroxide. After adjustment, the pH of Sample 52 shifted over time, which may indicate the need for a buffering system.

Use solutions having a concentration of 8 oz/gal were formed by diluting Samples 51 and 52 and Comparative Sample R with 5 grain water. The use solutions were applied and wiped from mirrors as described above in the streak test methodology. Samples 51 and 52 created very slight streaks on the mirrors and Comparative Sample R created severe streaks on the mirrors.

Samples 53 and 54

Samples 53 and 54 investigated the use of MGDA (Trilon® M) and tartaric acid at 17 grain hardness. Samples 53 and 54 were prepared according to Table 9 and included 0.05-2% glycerine, 1-20% Glucopon® 215 UP, 0.1-1% glass cleaner fragrance, and 0.01-1% Liquitint® blue HP.

TABLE 9

| | Water, deionized | Polymer | Trilon M, 40% | Tartaric acid | Approximate bio-based content of use solution |
|---|---|---|---|---|---|
| Sample 53 | 85-99.9% | 0% | 0.05-2% | 0% | 92% |
| Sample 54 | 85-99.9% | 0% | 0% | 0.05-2% | 96% |

The pH of Samples 53 and 54 were adjusted to 9.5. Sample 53 was adjusted with 50% citric acid white and Sample 54 was adjusted with 50% sodium hydroxide. After adjustment, the pH of Sample 54 shifted over time, which may indicate the need of a buffering system.

Use solutions having a concentration of 8 oz/gal were formed by diluting Samples 53 and 54 with 17 grain water. The use solutions were applied and wiped from mirrors as described. Samples 53 and 54 created very slight streaks on the mirrors.

Samples 55 and 56

Samples 55 and 56 investigated the ability of glycerine to reduce streaking when water hardness was present. Samples 55 and 56 contained 85-99.9% deionized water, 0.05-2% Trilon® M, 0.05-4% glycerine, 1-20% Glucopon® 215 UP, 0.1-1% glass cleaner fragrance, and 0.01-1% Liquitint® blue HP. The pH of Samples 55 and 56 was adjusted to 9.5 with citric acid white.

Sample 55 was diluted to an 8 oz/gal use solution with 5 grain water, and Sample 56 was diluted to an 8 oz/gal use solution with 17 grain water. The approximate bio-based content of the use solutions of Samples 55 and 56 was about 93%. The use solutions were applied to a glass surface and wiped with a lint free cloth. Sample 55 produced moderate streaks while Sample 56 produced very slight. Samples 55 and 56, which contained 0.05-4% glycerine, can also be compared to Samples 51 and 53 which contained 0.05-2% glycerine Example 3

Precision Force Applicator Cleaning Test

The precision force applicator (PFA) cleaning test was designed to compare the cleaning efficiency of cleaners. First, clean 12"×12" glass mirrors were scanned with an Epson Perfection V600 Photo Scanner to determine the initial reflectance value of each mirror. The glass mirrors were 12"×12" Stanley Basics Mirror Tiles, 3 mm thick with a plain edge.

Next, a synthetic sebum formula was formed by mixing 10% palmitic acid, 5% stearic acid, 15% coconut oil, 10% paraffin wax, 15% spermaceti, 20% olive oil, 5% squalene, 5% cholesterol, 10% oleic acid, and 5% linoleic acid.

The synthetic sebum formula was mixed with mineral oil and mineral spirits using a stir bar in a small bottle. Once the synthetic sebum dissolved, acetone, clay and titanium dioxide were added in turn, with the bottle being capped between additions. The completed glass soil mixture comprised: 0.50% synthetic sebum, 0.5% mineral oil, 49.25% mineral spirits, 49.25% acetone, 0.25% clay Kaopaque, and 0.25% titanium dioxide.

The glass soil mixture was placed in a Preval Sprayer, available from Precision Valve Corp., without the stir bar. The glass soil mixture was sprayed in a serpentine pattern onto a clean glass mirror from a distance of 1 foot with four evenly applied passes. The application began at a location 2 inches from the top horizontal edge and 2 inches from the left vertical edge and moved horizontally across the mirror until 2 inches beyond the right vertical edge. The serpentine pattern was continued until reaching the bottom of the mirror.

The mirror was placed the middle shelf in a preheated 50° C. oven for 1 minute. The mirror was then removed from the oven, rotated 90 degrees, and the soil mixture was applied to the mirror in the serpentine pattern described above. The mirror was returned to the oven for 1 minute. After the second 1 minute oven storage cycle, the 90 degree rotation, soil mixture application, and oven storage cycle was completed one more time, for a total of three soil mixture applications.

The soiled mirrors were stored at room temperature until all the mirrors had been prepared for the testing. Once all the mirrors were soiled, the soiled mirrors were placed in the 50° C. oven for 2 hours. After 2 hours, the soiled mirrors were removed and allowed to cool. A plastic bag is placed over the dish rack to prevent dust accumulation.

The mirrors are stored at room temperature for between 24 and 48 hours. Then the soiled mirrors are scanned using the Epson Perfection V600 Photo Scanner.

After the soiled mirrors had been scanned, the mirrors were cleaned with a precision force applicator cleaning instrument (PFA). A 9"×9" cheese cloth wipe was folded into fourths and placed into the cloth holder of the PFA. The cloth holder is attached to a carriage arm on the PFA. A soiled mirror was placed on the PFA and held in place by PFA side holders. Underlayment should be used so that the mirror and the PFA side holders are the same height.

The sample was sprayed onto the top half of the mirror and a 12" cardboard was used to protect the other half of the mirror from the spray test. The sample was applied evenly to the mirror in 9 spritzes (about 1.35 grams of sample). Within 60 seconds (dwell time), the mirror was positioned on the PFA by sliding the mirror flush with the top of the carriage, the side holders were tightened against the mirror and the PFA carriage containing the cheese cloth was adjusted to apply 1 lb normal force (NF) pressure on the mirror. At the end of the dwell time, the PFA carriage arm moved across the mirror surface so that the cheese cloth slid across the mirror surface and stopped on the glass side holder on the opposite side of the mirror. The cheese cloth was removed from the PFA and the PFA applicator was cleaned from any test cleaner residue with de-ionized water applied to a paper towel. The carriage arm was repositioned to −8.5 inches. A new cheese cloth was attached to the carriage arm, the sample was applied to the portion of the mirror now aligned with the carriage arm, and the PFA slid across this new portion of the mirror as described above. The cheese cloth application and mirror placement/cleaning steps were repeated until the PFA had moved across the entire top half of the mirror. The cleaned mirrors were scanned a final time with the Epson Perfection V600 Photo Scanner.

The scanned images of the initial mirrors, soiled mirrors and cleaned mirrors were analyzed with the imaging software "National Instrument Vision Builder AI 2009" to determine the intensity of each initial, soiled and cleaned mirror. The samples were tested in duplicate, and the average value and standard deviation for each sample was calculated with "Design Expert Statistical" software. A lower cleaned average intensity indicates a better cleaning efficiency.

Samples 57-59

Samples 57-59 were prepared according to Table 10. Table 10 also presents the bio-based content of each use solution. Note that Sample 57 does not have a bio-based content because it is 100% water, which is not included in the bio-based content calculation.

TABLE 10

| | Sample 57 | Sample 58 | Sample 59 |
|---|---|---|---|
| Water, deionized | | 85-99.9% | 85-99.9% |
| Water, 5 grain | 100% | | |
| Trilon M | | 0.05-2% | |
| Tartaric acid | | | 0.03-2% |
| Glycerine | | 0.05-2% | 0.05-2% |
| Glucopon 215UP | | 1-20% | 1-20% |
| Fragrance | | 0.1-1% | 0.1-1% |
| Dye | | 0.01-1% | 0.01-1% |
| Bio-based content of use solution | | 92% | 96% |

Samples 57-59 were diluted to 8 oz/gal with 5 grain water and used to clean soiled mirrors according to the PFA streak test described above. The pH of Samples 58 and 59 were adjusted to 9.5 prior to dilution. The pH of Sample 58 was adjusted with 50% citric acid white, and the pH of Sample 59 was adjusted with 50% sodium hydroxide. The results are presented in Table 11.

TABLE 11

| | Initial | | Soiled | | Cleaned | |
|---|---|---|---|---|---|---|
| | Average | St. Dev. | Average | St. Dev. | Average | St. Dev. |
| Sample 57 | 23.38 | 0.43 | 129.59 | 3.25 | 103.14 | 7.04 |
| Sample 58 | 23.33 | 0.03 | 126.96 | 4.83 | 66.89 | 13.38 |
| Sample 59 | 23.18 | 0.55 | 132.32 | 2.47 | 81.46 | 1.74 |

As shown by the lower average cleaned value, Sample 58, which included Trilon® M, provided a cleaner, more streak-free surface than Sample 59, which included tartaric acid.

Example 4

Cloud Point

The cloud point of a solution was determined by heating solution in beaker. The solution was heated until it became cloudy. Once the solution became cloudy, the solution was removed from the heat and was allowed to cool. The temperature of the solution was measured when the solution returned to a clear state. This temperature is the cloud point. A "no cloud point" result indicates that the solution did not turn cloudy.

Samples 60-65

Samples 60-65 investigated the cloud point of Oasis™ Pro 42 and a glass cleaning composition of the present invention. Sample 60 was concentrate Oasis™ Pro 42, Samples 61 and 62 were Oasis™ Pro 42 diluted to form use solutions at 4 oz/gal or 8 oz/gal, respectively. Samples 63-65 were concentrate glass cleaning compositions of the current invention and prepared according to Table 12.

TABLE 12

| | Sample 63 | Sample 64 | Sample 65 |
|---|---|---|---|
| Water, deionized | 85-99.9% | 75-99.9% | 65-99.9% |
| Trilon M | 0.05-2% | 0.05-3% | 0.05-4% |
| Glycerine | 0.05-2% | 0.05-3% | 0.05-4% |
| Glucopon 215UP | 1-20% | 1-25% | 1-30% |

TABLE 12-continued

| | Sample 63 | Sample 64 | Sample 65 |
|---|---|---|---|
| Fragrance | 0.1-1% | 0.1-1% | 0.1-1% |
| Dye | 0.01-1% | 0.01-1% | 0.01-1% |
| Bio-based content of use solution | 92% | | |

Sample 60 had a cloud point of 142° F. For Samples 61 and 62, no cloud point was observed up to 170° F. For Sample 63, no cloud point was observed up to 160° F. For Samples 64 and 65, no cloud point was observed up to 180° F.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A concentrate cleaning composition comprising:

water in an amount of greater than about 65% by weight of the concentrate cleaning composition;

a polycarboxylate polymer with a molecular weight between about 5,000 and about 100,000;

an amino-carboxylate comprising methyl glycine di-acetic acid;

glycerine in an amount of between about 0.05% and about 5% by weight of the concentrate cleaning composition; and at least one alkyl polyglycoside in an amount of between about 1% and about 25% by weight of the concentrate cleaning composition, wherein the concentrate cleaning composition has a bio-based content of at least about 75%, and wherein the ratio of amino-carboxylate to glycerine is between about 10:1 and about 1:4.

2. The concentrate cleaning composition of claim 1, wherein the amino-carboxylate is present in an amount between about 0.05% and about 5% by weight of the concentrate cleaning composition.

3. The concentrate cleaning composition of claim 2, wherein the ratio of amino-carboxylate to glycerine is between about 4:1 and about 1:2.

4. The concentrate cleaning composition of claim 1, wherein the polycarboxylate polymer comprises a sodium polycarboxylate copolymer in an amount between about 0.01% and about 5% by weight of the concentrate cleaning composition.

5. The concentrate cleaning composition of claim 1, wherein the polycarboxylate polymer comprises an acrylic/sulfonated co-polymer in an amount between about 0.01% and about 5% by weight of the concentrate cleaning composition.

6. The concentrate cleaning composition of claim 1, wherein the alkyl polyglycoside includes a C8 to C12 alkyl polyglycoside.

7. The concentrate cleaning composition of claim 1, further comprising an anti-mist component selected from the group consisting of polyethylene oxide and polyacrylamide.

8. The concentrate cleaning composition of claim 1 and further comprising between about 0.01% and about 0.3% polyethylene oxide, polyacrylamide or combinations thereof by weight of the concentrate cleaning composition, and wherein the concentrate cleaning composition does not contain anionic surfactants and polyoxypropylene-polyoxyethylene block co-polymers.

9. The concentrate cleaning composition of claim 1 wherein the concentrate cleaning composition has no cloud point up to 160° F.

10. The concentrate cleaning composition of claim 1, wherein the alkyl polyglycoside is an alkyl polyglucoside.

11. The concentrate cleaning composition of claim 1, wherein the alkyl polyglycoside is an alkyl polypentoside.

12. The concentrate cleaning composition of claim 1 consisting essentially of:

water;

at least one of glycerine or propylene glycol;

at least one alkyl polyglycoside;

at least one amino-carboxylate in an amount of between about 0.05% and about 5% by weight of the concentrate cleaning composition, wherein the amino-carboxylate comprises methyl glycine di-acetic acid;

at least one polymer selected from the group consisting of sodium polycarboxylates and acrylic/sulfonated co-polymers in an amount of between about 0.01% and about 5% by weight of the concentrate cleaning composition, wherein the polymer has a molecular weight between about 5,000 and about 100,000;

at least one anti-mist component selected from the group consisting of polyethylene oxide, polyacrylamide and polyacrylate; and at least one dye, at least one fragrance, at least one preservative, at least one defoaming agent or a combination thereof;

wherein the ratio of the amino-carboxylate to glycerine is between about 10:1 and about 1:4.

13. A method of using a cleaning composition use solution, the method comprising:

applying a cleaning composition use solution to a hard surface, the cleaning composition use solution comprising water, a polycarboxylate polymer having a molecular weight between about 5,000 and about 100,000, between about 75 ppm and about 800 ppm of at least one of glycerine or propylene glycol, between about 2,000 ppm and about 4,000 ppm of at least one alkyl polyglycoside, between about 200 ppm and about 600 ppm of amino-carboxylate comprising methyl glycine di-acetic acid, and between about 20 ppm and about 60 ppm of at least one of polyethylene oxide and polyacrylamide, wherein the ratio of amino-carboxylate to glycerine is between about 10:1 and about 1:4; and wiping the hard surface to remove the cleaning composition use solution.

14. The method of claim 13, wherein the ratio of amino-carboxylate to glycerine is between about 4:1 and about 1:2.

15. The method of claim 13, wherein the polycarboxylate polymer comprises at least one member selected from the group consisting of sodium polycarboxylate copolymers and acrylic/sulfonated co-polymers.

16. The method of claim 13, wherein the cleaning composition use solution does not contain polyoxypropylene-polyoxyethylene block co-polymers.

17. The method of claim 13, wherein the cleaning composition use solution further comprises an anti-mist component selected from the group consisting of polyethylene oxide, polyacrylamide and polyacrylate.

18. A method of forming a use solution, the method comprising:

mixing dilution water with a concentrate cleaning composition to form a use solution, wherein the concentrate cleaning composition comprises at least 65% water by weight of the concentrate cleaning composition, between about 0.05% and about 8% glycerine or propylene glycol by weight of the concentrate cleaning composition, between about 0.05% and about 5% by weight of an amino-carboxylate comprising methyl glycine di-acetic acid, between about 0.01% and about 5% a polycarboxylate polymer having a molecular weight between about 5,000 and about 100,000, and between about 1% and about 25% at least one alkyl polyglycoside by weight of the concentrate cleaning composition, wherein the cleaning composition use solution has a bio-based content of at least 75%, wherein the ratio of amino-carboxylate to glycerine is between about 10:1 and about 1:4, and wherein the use solution has a concentration of volatile organic compounds of not more than about 3%.

19. The method of claim 18, wherein the amino-carboxylate comprises between about 0.1% and about 3% by weight of the concentrate cleaning composition.

20. The method of claim 18, wherein the dilution water has a hardness of at least about 5 grains.

21. The method of claim 18, wherein the polycarboxylate polymer comprises at least one member selected from the group consisting of sodium polycarboxylate copolymers and acrylic/sulfonated co-polymers.

22. The method of claim 18, wherein the concentrate cleaning composition does not contain polyoxypropylene-polyoxyethylene block co-polymers or anionic surfactants.

23. The method of claim 18, wherein the concentrate cleaning composition further comprises an anti-mist component selected from the group consisting of polyethylene oxide and polyacrylamide.

24. The method of claim 18, wherein the use solution contains 0% volatile organic compounds.

25. A concentrate cleaning composition comprising:

water in an amount of between about 20% and about 99.9% by weight of the concentrate cleaning composition;

amino-carboxylate comprising methyl glycine di-acetic acid in an amount between about 0.05% and about 5% by weight of the concentrate cleaning composition;

glycerine in an amount of between about 0.05% and about 30% by weight of the concentrate cleaning composition;

at least one alkyl polyglycoside in an amount of between about 0.05% and about 50% by weight of the concentrate cleaning composition; and a polycarboxylate polymer having a molecular weight between about 5,000 and about 100,000 in an amount between about 0.01% and about 5% by weight of the concentrate cleaning composition;

wherein the ratio of amino-carboxylate to glycerine is between about 10:1 and about 1:4.

26. The concentrate cleaning composition of claim 25, further comprising between about 0.01% and about 3.0% polyethylene oxide, polyacrylamide or combinations thereof by weight of the concentrate cleaning composition and wherein the concentrate cleaning composition does not contain organic solvents, ammonia compounds, alkanol amines, and polyoxypropylene-polyoxyethylene block co-polymers.

* * * * *